United States Patent [19]

Gorondy

[11] Patent Number: 4,636,449

[45] Date of Patent: Jan. 13, 1987

[54] ELECTROSTATIC PRINTING PROCESS

[75] Inventor: Emery J. Gorondy, Chadds Ford, Pa.

[73] Assignee: E. I. Du Pont de Nemours and Company, Wilmington, Del.

[21] Appl. No.: 557,275

[22] Filed: Dec. 2, 1983

Related U.S. Application Data

[63] Continuation-in-part of Ser. No. 392,788, Jun. 28, 1982, abandoned.

[51] Int. Cl.[4] ..... G03G 19/00

[52] U.S. Cl. ..... 430/39; 430/49; 430/126

[58] Field of Search ..... 430/39, 49, 126

[56] References Cited

U.S. PATENT DOCUMENTS 3,063,859 11/1962 Heckscher ..... 430/126 X
3,250,636 5/1966 Wilforth ..... 430/39 X
3,271,146 9/1966 Robinson ..... 430/126 X

*Primary Examiner*—Roland E. Martin

[57] ABSTRACT

An electrostatic printing process is disclosed wherein a printing roll is formed by forming a latent magnetic image in a magnetic imaging member, decorating the latent magnetic image with a nonconductive magnetic toner to form a toner image, transferring the toner image to a conductive member and temporarily fixing the toner image to the conductive member. The toner image on the conductive member is electrostatically charged, while the charge is dissipated from the remaining area of the conductive member. The charged image of magnetic toner is decorated with an electrostatic toner comprising a colorant and a binder resin to form an electrostatic image which is transferred to a substrate. Pattern change is accomplished by washing off the fused toner from the conductive print roll and forming a new fused toner image on it.

7 Claims, 2 Drawing Figures

ELECTROSTATIC PRINTING PROCESS

RELATED APPLICATION

This application is a continuation-in-part of Ser. No. 392,788 filed June 28, 1982 abandoned.

BACKGROUND OF THE INVENTION

1. Field of the Invention

The present invention relates to electrostatic printing rolls, and their preparation, by magnetically forming an image of nonconductive toner on a conductive image bearing magnetic roll followed by transfer of the toner to a conductive substrate to form the electrostatic printing roll. The areas of the electrostatic printing charged while the charge is dissipated from the conductive nonimage areas. The charged nonconductive areas are decorated with an oppositely charged toner containing a colorant such as a dye or pigment, which toner is then transferred to a substrate and permanently fixed thereto.

2. Description of the Prior Art

Magnetic printing processes, particularly useful in overcoming the problem in electrostatic copying processes of unsatisfactory copying of large dark areas, are known in the art. Such processes are described, for instance, in U.S. Pat. Nos. 4,099,186 and 4,117,498. The particular processes described in U.S. Pat. Nos. 4,099,186 and 4,117,498 relate to processes wherein a dye and/or other chemical treating agent contained in a ferromagnetic toner is transferred directly to a substrate, e.g., such as a textile material, or is transferred to a first substrate such as paper for subsequent transfer to the ultimate substrate. However, all these techniques relied on removal of the resin and magnetic components of the toner from the substrate after dyeing, hence, eliminating the use of this technique in the pigment printing of textiles.

More recently magnetic printing has been used to form the resist when preparing printed circuits or printing plates by etching or plating, or to produde lithographic plates directly. Such processes are described in U.S. Pat. No. 4,292,120 and U.S. Ser. No. 173,871, filed July 30, 1980, now U.S. Pat. No. 4,338,391.

A serious problem in the prior art is that magnetically attractive toners are not provided in a variety of colors but are generally black, dark reddish brown or a dark bluish black. Thus, an image through color magnetography, while theoretically possible, it is impractical in the present state of the technology.

SUMMARY OF THE INVENTION

The process of the present invention involves making electrostatic printing rolls by magnetography. First a latent magnetic image is formed on a conductive magnetic imaging member. The latent magnetic image is decorated with a nonconductive magnetic toner and the toner transferred to a conductive roll. Then the toner is fused to the conductive roll. The fused nonconductive toner is then electrostatically charged with a suitable means such as a DC corona while the charge is removed from the conductive areas of the roll which are grounded. Then the electrostatically charged areas of the printing roll are decorated with electrostatic toner which is transferred to a substrate and permanently fixed thereto. When a new image is to be printed, the toner image is removed from the conductive roll by washing it with a suitable resin-dissolving solvent, drying and repeating the above-described process.

DETAILED DESCRIPTION OF THE DRAWINGS

Figure 1:
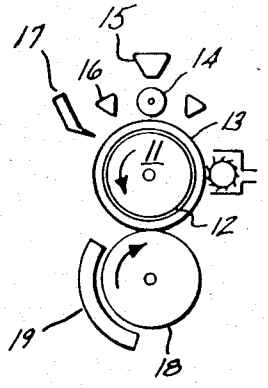
FIG. 1 is a schematic view of the device used to form an image of magnetic toner on a conductive printing roll.

Referring now to FIG. 1, a roll 11, surfaced with a conductive layer 12, which in turn is covered with a magnetic member 13, is rotated past a magnetic decorator roll 14 fitted with magnetic toner hopper 15. After the magnetic toner has been applied to magnetic layer 13, by decorator roll 14, AC corona 16 serves to neutralize any electrostatic charges which may be attracting magnetic toner particles to magnetic imaging member 13. Magnetic toner particles which are on nonimage areas of magnetic imaging member 13 are removed by vacuum knife 17. The magnetic toner image is then transferred to conductive roll 18 by means of pressure and heat supplied by lamp 19.

Figure 2:
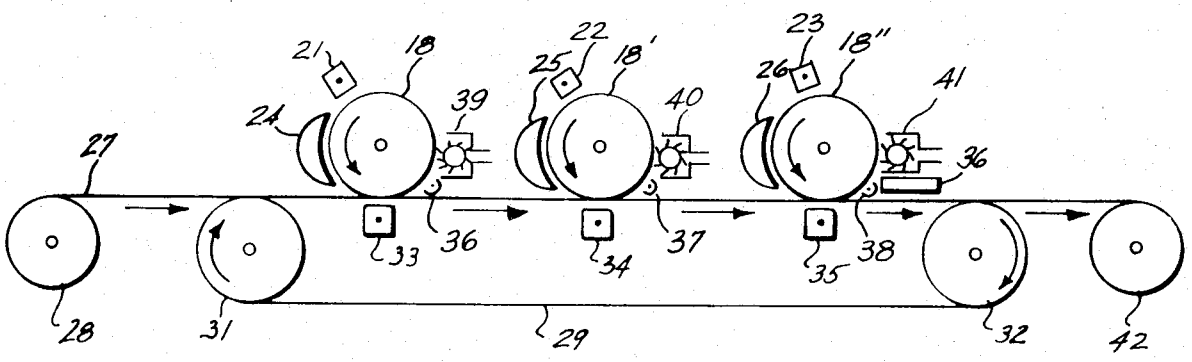
FIG. 2 is a schematic view of a printer using three of the printing rolls prepared in FIG. 1.

The conductive roll with the magnetic toner image is removed from the system. If desired the magnetic toner image may be further treated such as with solvent vapors or heat to further coalesce the magnetic toner particles. Referring now to FIG. 2, a plurality of conductive rolls 18, 18′, 18″ with a nonconductive magnetic toner image are mounted in a multi-stage printer. The magnetic toner areas of rolls 18, 18′, 18″ are electrostatically charged by means of DC coronas 21, 22, 23. Electrostatic toner is then cascaded over rolls 18, 18′, 18″ by decorators 24, 25, 26 to decorate the fused magnetic toner image thereon with electrostatic toner. A substrate 27 is unwound from roll 28 and 20 passed onto endless belt 29 supported by rollers 31 and 32. As substrate 27 passes under rolls 18, 18′ and 18″, DC coronas 33, 34, 35 cause the toner on rolls 18, 18′, 18″ to transfer to substrate 27. Toner which did not transfer to substrate 27 is neutralized by AC coronas 36, 37, 38 and removed by vacuum brushes 39, 40 and 41. After substrate 27 passes the last printing station the toner is fused to substrate 27 by heater 36. Finally substrate 27 is taken up on roll 42.

DETAILED DESCRIPTION

The magnetic imaging member used in the magnetic printing step may be first magnetically structured and then selectively demagnetized in the background areas by heating such background areas above the Curie point of the magnetic material in the magnetic imaging member to leave a latent magnetic image. Alternatively the latent magnetic image may be formed in the magnetic imaging member by means of a magnetic write head.

Preferably the magnetic imaging member is magnetically structured to have from about 40 to 1200 magnetic lines per cm. As used herein, a magnetic line contains one north pole and one south pole. Preferably the magnetic imaging member is formed of a layer of acicular chromium dioxide in a binder on an electrically conductive support. The acicular chromium dioxide layer generally is from 1.3 to 50 micrometers in thickness, and preferably is from 4 to 13 micrometers in thickness.

The magnetic imaging member can be used either mounted in the form of an endless belt supported by a plurality of rolls or mounted on a cylindrical printing roll. The imaging and toning steps are separate entities which do not need to be done consecutively in predetermined sequential fashion. For instance, it may be desired to mount a preimaged magnetic imaging member on a printing roll.

The imaging member containing the latent magnetic image is then brought into superimposed relationship with the conductive member to which the toner image is to be transferred. At this point a DC corona, situated on the side of the conductive member away from the imaging member bearing the toner, causes the toner to transfer to the conductive member. At this point the conductive member must be insulated from ground.

After being transferred to the conductive member the toner is temporarily fixed to the conductive member. Generally this is most readily achieved by the application of heat which causes the toner particles to coalesce and become fused to each other as well as to the conductive member. Generally the application of pressure is unnecessary; but if pressure is to be applied the pressure applying means should be covered with a material to which the toner will not adhere, such as poly(tetrafluoroethylene).

If desired the magnetic toner can be transferred from the magnetic imaging member to an intermediate transfer member and then permanently applied to the conductive member, such as described in U.S. Pat. No. 4,292,120.

The conductive member is then mounted in a suitable electrostatic printing apparatus. Generally the conductive member is mounted on a roller which in turn is part of an electrostatic printing machine.

Then the toner image on the conductive member is electrostatically charged. This is most readily achieved by exposing the toner image to a DC corona, while electrically grounding the conductive member. Alternatively the conductive member can be electrically charged and then discharged leaving the toner image electrically charged.

The charged toner image is then decorated with an electrostatic toner. This can be done with a magnetic brush where the toner particles are charged triboelectrically or by charging the toner particles in a cascade type decorator.

The electrostatic toner is then transferred to a substrate such as cotton, wool, polyester/cotton or their blends, paper or a film. This can be done either electrostatically or by application of pressure or heat and pressure.

The magnetic toner particles fused to the conductive roll preferably are magnetic pigments encapsulated in a suitable binder. Generally the toner particles have an average size ranging from 10 to 30 microns with a preferred average size ranging from 15 to 20 microns. Spherical particles such as prepared by spray drying are preferred because of their superior flow properties which can be enhanced by the addition of minute amounts of a flow additive such as fumed silica. A further description of the preparation of toner particles may be found in U.S. Pat. No. 3,627,682. When using the apparatus disclosed herein the toner particles should have a low electrical conductivity. If the particles have high conductivity, they will be passed back and forth between the drum and the paper causing a diffuse image and low transfer efficiency. Generally the toner powder electrical conductivity is less than $1\times10^{-13}$ mho/cm. The ferromagnetic component can consist of hard magnetic particles or a binary mixture of hard and soft magnetic particles. The magnetically soft particles can be iron or another high permeable, low-remanence material, such as certain ferrites, for example, (Zn, Mn)$Fe_2O_4$ or permalloys. The magnetically hard particles can be an iron oxide, preferably $Fe_3O_4$, y—$Fe_2O_3$, other ferrites, for example, $BaFE_{12}O_{19}$, chi-iron carbide, chromium dioxide or alloys of $Fe_3O_4$ and nickel or cobalt. A magnetically hard substance has a high-intrinsic coercivity, ranging generally from about 40 to about 40,000 oersteds and a high remanence (20 percent or more of the saturation magnetization) when removed from the magnetic field. Such substances are of low permeability and require high fields for magnetic saturation. A magnetically soft substance has low coercivity, for example, one oersted or less, high permeability, permitting saturation to be obtained with a small applied field, and exhibits a remanence of less than 5 percent of the saturation magnetization. A particularly preferred toner has an average particle size of 20 microns and contains 40 weight percent thermoplastic binder 30 weight percent $Fe_3O_4$ (magnetite) and 30 weight percent soft iron (carbonyl iron).

The electrostatic toner particles used in decorating the electrostatic printing roll are a colorant encapsulated in a suitable binder. Generally the electrostatic toner will have an average particle size of from 15 to 20 microns. Spherical particles such as prepared by spray drying are preferred because of their superior flow properties. Generally the electrostatic toner will contain from 1.0 to 20.0 wt.% pigment and from 80.0 to 99.0 wt.% of a thermoplastic binder. Suitable pigments include copper phthalocyanine, halogenerated copper phthalocyanines, quinacridone, quinacridonequinone, etc.

The present method employs the advantage of magnetographic imaging which permits one to create large solid color areas with the advantages of xerographic printing which allows one to use colored toners of any color. A serious problem in the prior art which is overcome by the present invention is that magnetically attractive toners are not provided in a variety of colors but are generally black, dark reddish brown or a dark bluish black. Colored toners which are magnetically attractable to a substrate do not come in the range of colors which are necessary to produce a colored image of high quality. Thus, an image through color magnetography, while theoretically possible, is impractical in the present state of the technology. A method is disclosed whereby electrostatic type toners which are available in desirable colors may be used in conjunction with a magnetographic imaging system to create colored areas. Thus highly colored areas may be formed, e.g., magenta, green, yellow, etc. may be created on a substrate.

Example

A magnetic imaging member formed of a 350 inches (8.9$\mu$ meters) thick layer of acicular chromium dioxide in a binder on an electrically grounded silver coated rubber roll which is 12 inches (0.3 meter) wide. The magnetic imaging member is magnetically structured to 460 pole reversals/inch (18 pole reversals/mm) or 230 cycles/inch (9 cycles/mm) or 55 microns per pole reversal by recording a square wave with a magnetic write head at 35 m Amps and 6 to 8 volts. A film positive of the image to be printed is placed in contact with the magnetic roll and stepwise uniformly illuminated by a Xenon flash at 3.3 KV with a 15° turn per flash passing through the film positive, corresponding to the areas to be printed, absorb the energy of the Xenon flash; whereas the clear areas transmit the light and heat the acicular chromium dioxide beyond its Curie point of about 116° C. thereby demagnetizing the exposed magnetized lines of acicular chromium dioxide. A nonconductive toner is fed from a slot in a hopper to decorate the latent magnetic image by means of a decorator. The decorator comprises a rotating magnetic cylinder inside a nonmagnetic sleeve. As the magnetic imaging member rotates after being decorated with toner it passes an AC corona which serves to neutralize any electrostatic charges which may cause toner to adhere to the magnetic imaging member. Then a vacuum knife removes stray toner from the nonimage areas. The toner is then negatively charged with a DC corona. The toner is then transferred to a positively charged copper sheet having a polyethylene terephthalate film backing.

The toner is then fused to the copper sheet. The copper sheet is grounded and the toner fused thereto is positively charged with a DC corona. An electrostatic toner is negatively charged and then poured over the side of the copper sheet to which the charges fused toner is adhered. The negatively charged toner adheres to the charged fused toner and not to the grounded background copper areas. A sheet of paper is laid over the toner and positively charged with a DC corona to effect transfer of the negatively charged toner to the paper. The toner is then fused to the paper by heating.

What is claimed is:

1. A process for producing a colored image on a substrate comprising the steps of forming a latent magnetic image in a magnetic imaging member, decorating the latent magnetic image with nonconductive magnetic toner, transferring the magnetic toner to a conductive member to form a nonconductive toner image fused to said conductive member, electrostatically charging the nonconductive toner image, decorating the charged nonconductive toner image with electrostatic colored toner comprising a resin and a colorant, transferring the resulting electrostatic colored toner image to a substrate.

2. The process of claim 1 wherein the colorant in the electrostatic toner is a pigment.

3. The process of claim 2 wherein the conductive member is a metal printing roll.

4. The process of claim 3 wherein the substrate being printed is a textile material.

5. The process of claim 4 wherein the textile material is cotton, wool, polyester or blends thereof.

6. The process of claim 3 wherein the substrate is paper or a film.

7. The process of claim 1 wherein the colored image on the substrate includes magenta, green or yellow.

* * * * *